US005500488A

United States Patent [19]

Buckel

[11] Patent Number: 5,500,488

[45] Date of Patent: Mar. 19, 1996

[54] WIDE BAND HIGH FREQUENCY COMPATIBLE ELECTRICAL COAXIAL CABLE

[76] Inventor: Konrad Buckel, Nördliche Ringstrasse 21, 91781 Weissenburg, Germany

[21] Appl. No.: 278,731

[22] Filed: Jul. 21, 1994

[51] Int. Cl.[6] ..... H01B 7/34

[52] U.S. Cl. ..... 174/102 R; 174/36; 174/106 R; 174/131 A

[58] Field of Search ..... 174/102 R, 36, 174/107, 113 C, 131 A, 106 R, 126.2

[56] References Cited

U.S. PATENT DOCUMENTS

| | | | |
|---|---|---|---|
| 2,041,147 | 5/1936 | Preisach . | |
| 2,759,990 | 8/1956 | Bean | 174/69 |
| 3,309,455 | 3/1967 | Mildner | 174/29 |
| 3,717,719 | 2/1973 | Smith et al. . | |
| 3,823,253 | 7/1974 | Walters et al. | 174/69 |
| 4,567,321 | 1/1986 | Harayama | 174/117 F |
| 4,642,417 | 2/1987 | Ruthrof et al. | 174/36 |
| 4,767,890 | 8/1988 | Magnan | 174/28 |
| 4,816,611 | 3/1989 | Invernizzi | 174/102 R |
| 5,068,497 | 11/1991 | Krieger | 174/106 R |
| 5,144,098 | 9/1992 | VanDeusen | 174/36 |
| 5,210,377 | 5/1993 | Kennedy et al. | 174/107 |

FOREIGN PATENT DOCUMENTS

| | | | |
|---|---|---|---|
| 0504776 | 3/1992 | European Pat. Off. . | |
| 928287 | 11/1945 | France . | |
| 1075332 | 10/1954 | France | 174/131 A |
| 913431 | 6/1954 | Germany . | |
| 1055631 | 1/1955 | Germany . | |
| 1100117 | 2/1961 | Germany . | |
| 2851388 | 11/1978 | Germany . | |
| 3108970 | 3/1981 | Germany . | |
| 3433834 | 9/1984 | Germany . | |
| 3311628 | 10/1984 | Germany | 174/131 A |
| 3638281 | 11/1986 | Germany . | |
| 3934213 | 10/1989 | Germany . | |
| 1146319 | 11/1967 | United Kingdom . | |
| 2056157 | 8/1979 | United Kingdom . | |
| 2023328 | 12/1979 | United Kingdom | 174/113 C |

OTHER PUBLICATIONS

Patent Abstracts of Japan–vol. 13, No. 558 (E–858) 12 Dec. 1989 & JP–A–12 032 611 (Sumitomo Electric) 18 Sep. 1989.

*Primary Examiner*—Morris H. Nimmo
*Attorney, Agent, or Firm*—Victor M. Genco, Jr.

[57] ABSTRACT

A wide-band high frequency compatible electrical coaxial cable is provided with an outer conductor, a dielectric, and an inner conductor that is arranged about a plastic core and includes an inner layer of film that is surrounded by and in electrical contact with a plurality of twisted round conductors.

9 Claims, 1 Drawing Sheet

WIDE BAND HIGH FREQUENCY COMPATIBLE ELECTRICAL COAXIAL CABLE

FIELD OF THE INVENTION

The invention relates to a wide band high frequency compatible electrical coaxial cable with a cylindrical inner conductor arranged around a plastic core, a concentric outer conductor and a dielectric located between the inner conductor and the outer conductor. The inner conductor is comprised of an inner electrically conductive film layer in electrical contact with an outer layer comprising a plurality of twisted conductors.

BACKGROUND OF THE INVENTION

Usually coaxial cables must fulfill certain electrical and mechanical conditions for use in high frequency ranges over a wide frequency band, for example, from the MHz to the GHz range. The following electrical properties are desirable:

low signal attenuation
high return loss
load carrying capacity

In addition, the following mechanical properties are desirable:

high flexibility
long service life under flexing and/or drum winding load
sturdy design resistant to strain and/or pressure loads, and
small cable diameters.

A low signal attenuation is desirable in order to transmit signals over distances of maximum length. A high return loss makes wave impedance of the cable as constant as possible over its length. Changes in wave impedance along the cable lead to disturbing signal reflections and signal reflux. For a certain load carrying capacity, the inner and the outer conductors of the cable need a certain minimum diameter for the low frequency range. With rising frequency, the skin effect becomes more and more noticeable. An important role is played by the dielectric between the inner and the outer conductor, in particular by its dielectric constant and its dielectric loss factor.

A cable with an inner conductor in the form of massive copper or a massive copper tube has very good electric properties. However, it does not have the desired mechanical properties. A massive copper tube causes the cable to be virtually unbendable and cannot be wound around a cable drum.

Generally, the goal for a cable is one with optimal compromise between the desired electrical and mechanical properties. Cables with focus on low signal attenuation are known as "Zellflex" or "Flexwell" cables and their inner conductor is in the form of a corrugated copper tube. Its structure resembles a flexible shower tube so as to cause the inner conductor to be flexible to a certain degree. Nevertheless such cables are not very flexible and these cables can hardly be wound up on drums, i.e., their bending radius is very large.

Coaxial cables with an inner conductor in the form of braided flat or round conductors arranged around a plastic core have better bending and drum winding properties. However, they are relatively complex and cost-intensive to manufacture. When subjected to frequent bending and drum cycles, they have a relatively short service life.

There is a need for a low-attenuation coaxial cable which optimizes desired electrical and mechanical properties as well as manufacturing costs.

SUMMARY OF THE INVENTION

A wide-band high frequency compatible electrical coaxial cable is provided having an outer conductor, a dielectric located between the outer conductor and an inner conductor, and the inner conductor disposed concentrically within the outer conductor wherein the inner conductor is arranged around a plastic core and wherein the inner conductor further comprises two layers with an inner layer in the form of an overlappingly and helically wrapped electrical conductive film and an outer layer in the form of a combination of twisted round conductors that are in electrical contact with the inner layer.

The inner layer of the inner conductor may be a copper film, a silver plated film, or a silver-plated copper film. The outer layer of the inner conductor may be comprised of copper round conductors, silver-plated, or silver-plated copper round conductors. The plastic core about which the inner conductor is arranged may incorporate fluoroethylenepropylene. The plastic core may also be hollow. The outer conductor of the coaxial cable may be surrounded by a plastic jacket. The dielectric may be comprised of microporous polytetrafluoroethylene.

BRIEF DESCRIPTION OF THE DRAWINGS

The FIGURE is a cross-sectional view of the inventive cable.

DETAILED DESCRIPTION OF THE PREFERRED EMBODIMENT

Figure 1:
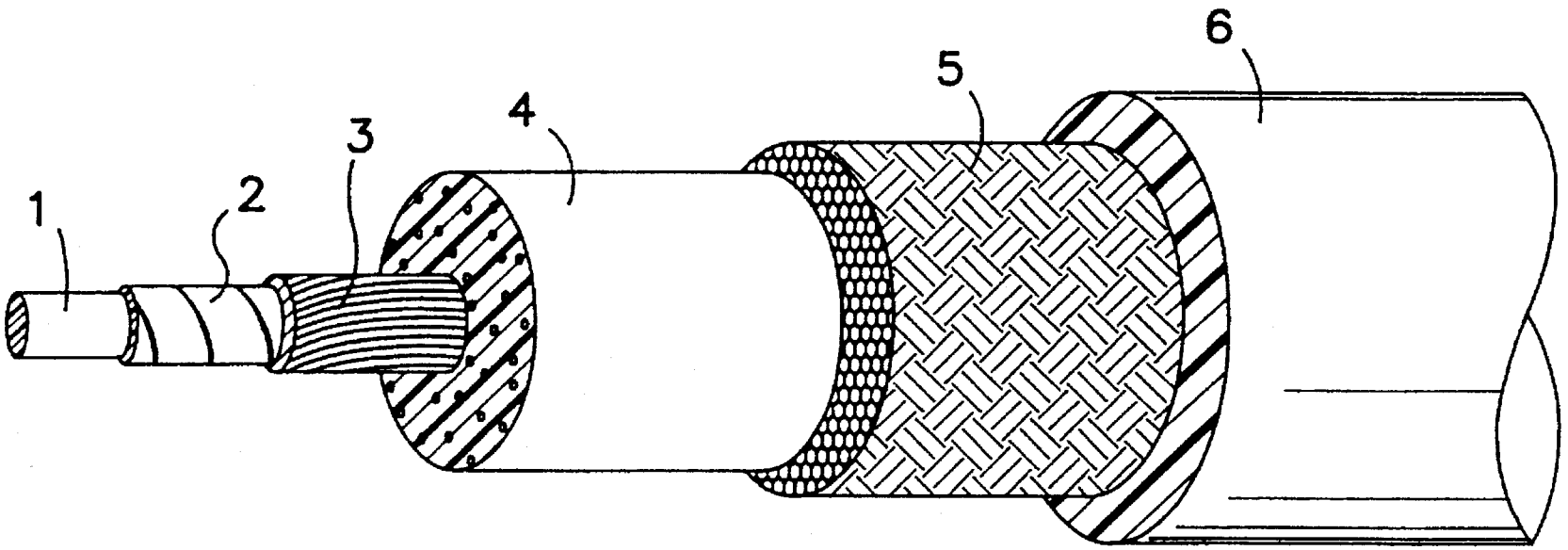

A wide band high frequency coaxial cable is provided comprising an outer conductor, a dielectric located between the outer conductor and inner conductor, and an inner conductor wherein the inner conductor is arranged concentrically within the outer conductor and around a plastic core, and wherein the inner conductor includes an inner film layer and an outer layer of a plurality of round conductors that are in electrical contact with the inner film layer.

Both the helical winding of an electrically conductive film over a plastic core and the twisting of twisted conductors on a round core are manufacturing processes which are much faster than the braiding of round or flat conductors on a core. Less complicated machines are required and the machines require less time for setting and preparation.

In a particularly preferred embodiment, the inner layer of the inner conductor consists of a silver-plated copper film on which a construction of twisted round silver-plated copper wires is arranged. The inner layer may also be comprised of a silver-plated or copper film. The outer layer of wires may also be comprised of copper wires or silver-plated wires. The plastic core of the inner conductor may be formed from hollow FEP (fluoroethylene propylene). The dielectric between the inner conductor and the outer conductor is preferably microporous PTFE (polytetrafluoroethylene). The plastic core and dielectric may be made in general from any fluorothermoplastic that is preferably foamed such as FEP. The outer conductor of the inventive cable may be comprised of any currently existing materials used for outer conductors and shields. A cable jacket may also be used to surround the outer conductor. The cable jacket may be comprised of materials including thermoplastics such as polyurethane, fluorothermoplastics such as FEP, and elastomers such as polyester compounds.

The invention is best understood by reference to the accompanying drawing. The FIGURE shows an embodiment of a coaxial cable from inside out: a plastic core 1, a silver-plated copper film 2 wrapped around the plastic core, a combination of twisted round silver-plated copper conductors 3 applied over the copper film 2, a dielectric 4, a shield construction 5 as an outer conductor and a plastic jacket 6. The plastic core 1, the copper film 2 and the combination of twisted round conductors 3 form the inner conductor construction of this coaxial cable.

The signal attenuation alpha of a coaxial cable is shown by the following equation:

$$\alpha = K_1 \cdot \left[ \frac{\sqrt{f} \cdot \sqrt{\rho}}{Zo} \cdot \left( \frac{1}{d} \cdot \frac{1}{D} \right) + K_2 \cdot \sqrt{\epsilon_r} + \tan\delta \cdot f \right] \quad (1)$$

where f=frequency

ρ=specific conductor resistance

Zo=wave impedance of the coaxial cable d=outer diameter of the inner conductor

D=inner diameter of the outer conductor $K_1$=constant $K_2$=constant $\epsilon_r$=relative dielectric constant tanδ=dielectric loss factor The equation for the wave impedance Zo is as follows:

$$Zo = \sqrt{\frac{L}{C}} \quad (2)$$

In this equation L=inductance, C=capacitance

As shown by equation (1), the signal attenuation depends on the wave impedance, the outer diameter of the inner conductor and the inner diameter of the outer conductor of the coaxial cable. If the same signal attenuation is to be obtained with the inventive cable as compared to a conventional coaxial cable with a copper tube as the inner conductor without changing the cable construction, the same wave impedance and the same outer diameter of the inner conductor construction must be ensured. If only the combination of round twisted conductors 3 were applied around the plastic core 1, the conductors would need to have a slightly larger radial thickness than the comparative copper tube but the same outer diameter is required to obtain the same load carrying capacity as a solid copper tube at low frequencies (i.e. , 1–100 MHz) where the skin effect is not as strong. On the other hand, the same outer diameter as that of the copper tube would be needed if the rest of the cable construction is to stay the same to keep the signal attenuation equally low. The precondition, however, is that the exchange of the copper tube by a combination of twisted round conductors does not change the wave impedance Zo. This precondition can, however, not be fulfilled if the plastic core 1 is only surrounded by the combination of twisted round conductors 3. The reason is that such a combination of twisted round conductors considerably increases the inductance of the inner conductor and thus of the cable, which—according to equation (2)—will considerably change the wave impedance. The wave impedance, which is normally specified as a nominal value to be fulfilled as well as possible to prevent signal reflections in the entire system incorporating the coaxial cable, must not be changed.

According to the invention, the problem is solved in that the combination of twisted round conductors 3 is located above the helically overlapping wrapped copper film 2 with electrical contact between the copper film 2 and the combination of twisted round conductors 3. In this way the inductance of the combination of twisted round conductors 3 is short-circuited and thus eliminated. This results in a total inductance L equal to that of a coaxial cable with a solid copper tube as the inner conductor with otherwise the same cable construction.

A two-layer inner conductor has another advantage. As previously discussed, an inner conductor formed only by a combination of twisted round conductors needs to be as thick as the copper tube of known coaxial cables to ensure the same load and current carrying capacity. Such a combination of twisted round conductors requires copper wires of adequate thickness. Their flexibility is considerably less than the thickness of the copper wires which are used in the combination of twisted round conductors 3 of a double-layer inner conductor as described herein. The distribution of the cross-section of the inner conductor to the combination of copper film 2 and the round twisted conductors 3 thus makes the cable more flexible.

In general the thickness of the inner film 2 should range from 0.01 to 0.1 mm and is preferably 0.05 mm. The diameters of the twisted conductors 3 of the inner conductor should range from 0.1 to 1 mm and are preferably 0.5 mm. The overall diameter of the inner conductor disposed concentrically around the core 1 ranges from 2 to 10 mm. The overall diameter of the entire construction of the inventive cable including the outer jacket is preferably between 10 and 25 mm.

Other modifications of the inventive cable will become apparent to those skilled in the art from the foregoing description and accompanying FIGURE. Such modifications are intended to fall within the scope of the appended claims.

I claim:

1. A wide-band high frequency compatible electrical coaxial cable comprising:

a. an outer conductor;

b. a dielectric located between the outer conductor and an inner conductor; and c. the inner conductor disposed concentrically within the outer conductor wherein the inner conductor is arranged around a plastic core and wherein the inner conductor further comprises two layers with an inner layer in the form of an overlappingly and helically wrapped electrical conductive film and an outer layer in the form of a plurality of twisted round conductors that are in electrical contact with the inner layer.

2. A coaxial cable of claim 1, wherein the film is selected from a group consisting of copper films, silver-plated films, and silver-plated copper films.

3. A coaxial cable of claim 1, wherein the outer layer of the inner conductor is comprised of twisted wires.

4. A coaxial cable of claim 3, wherein the wires of the outer layer are selected from a group consisting of copper wires, silver-plated wires, and silver-plated copper wires.

5. A coaxial cable of claim 1, wherein the plastic core incorporates fluoroethylenepropylene.

6. A coaxial cable of claim 1, wherein the plastic core is hollow.

7. A coaxial cable of claim 1, wherein the outer conductor is surrounded by a plastic jacket.

8. A coaxial cable of claim 7, wherein the plastic jacket is constructed from a material selected from a group consisting of thermoplastics, fluorothermo-plastics, and elastomers.

9. A coaxial cable of claim 1, wherein the dielectric is comprised of microporous polytetrafluoroethylene.

* * * * *